US009208799B2

(12) United States Patent
Gigi

(10) Patent No.: US 9,208,799 B2
(45) Date of Patent: Dec. 8, 2015

(54) METHOD AND DEVICE FOR ESTIMATING A PATTERN IN A SIGNAL

(75) Inventor: Ercan Ferit Gigi, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 238 days.

(21) Appl. No.: 13/883,647

(22) PCT Filed: Nov. 7, 2011

(86) PCT No.: PCT/IB2011/054951
§ 371 (c)(1),
(2), (4) Date: May 6, 2013

(87) PCT Pub. No.: WO2012/063185
PCT Pub. Date: May 18, 2012

(65) Prior Publication Data

US 2013/0231926 A1 Sep. 5, 2013

(30) Foreign Application Priority Data

Nov. 10, 2010 (EP) ..... 10190709

(51) Int. Cl.
*G10L 19/04* (2013.01)
*G10L 25/90* (2013.01)

(52) U.S. Cl.
CPC ..... *G10L 25/90* (2013.01)

(58) Field of Classification Search
CPC ..... G10L 25/90; G10L 19/09; G10L 19/08; G10L 21/04; H05K 999/99
See application file for complete search history.

(56) References Cited

U.S. PATENT DOCUMENTS

| | | | | |
|---|---|---|---|---|
| 3,617,636 | A | 11/1971 | Ogihara | |
| 3,622,966 | A * | 11/1971 | George et al. | 367/42 |
| 4,706,290 | A * | 11/1987 | Lin | 381/58 |
| 4,720,802 | A * | 1/1988 | Damoulakis et al. | 704/233 |
| 4,791,671 | A | 12/1988 | Willems | |
| 5,781,880 | A | 7/1998 | Su | |
| 5,864,795 | A * | 1/1999 | Bartkowiak | 704/216 |
| 5,946,650 | A * | 8/1999 | Wei | 704/207 |
| 6,018,706 | A | 1/2000 | Huang et al. | |
| 6,067,511 | A * | 5/2000 | Grabb et al. | 704/223 |

(Continued)

FOREIGN PATENT DOCUMENTS

CN 101853240 A 10/2010

OTHER PUBLICATIONS

Stephen A. Zahorian and Hongbing Hu. A Spectral/temporal method for Robust Fundamental Frequency Tracking. The Journal of the Acoustical Society of America, 123 (6), 2008. doi:10.1121/1.2916590.*

H. K. Kim and H. S. Lee, "Use of spectral autocorrelation in spectral envelope linear prediction for speech recognition", IEEE Transactions on Speech and Audio Processing, vol. 7, No. 5, Sep. 1999.*

(Continued)

*Primary Examiner* — Paras D Shah
*Assistant Examiner* — Fariba Sirjani

(57) ABSTRACT

The present invention relates to a method for estimating a pattern, in particular a pitch and/or a fundamental frequency, in a signal having a periodic, quasiperiodic or virtually periodic component, wherein the signal is transformed from a time-domain to a frequency-domain to obtain a spectrum of the signal, the spectrum is processed to obtain a zero-phase spectrum of the signal, the spectrum of the signal is transformed to the time-domain to obtain a correlation signal, the spectrum and the correlation signals are combined to a combined spectrum, and the pattern is estimated on the basis of the combined spectrum.

15 Claims, 8 Drawing Sheets

(56) References Cited

U.S. PATENT DOCUMENTS

| | | | | |
|---|---|---|---|---|
| 6,128,591 | A * | 10/2000 | Taori et al. | 704/214 |
| 6,208,958 | B1 * | 3/2001 | Cho et al. | 704/207 |
| 6,459,914 | B1 * | 10/2002 | Gustafsson et al. | 455/570 |
| 6,470,311 | B1 * | 10/2002 | Moncur | 704/208 |
| 2004/0128130 | A1 * | 7/2004 | Rose et al. | 704/236 |
| 2004/0167775 | A1 * | 8/2004 | Sorin | 704/208 |
| 2007/0036360 | A1 * | 2/2007 | Breebaart | 381/23 |
| 2007/0198263 | A1 * | 8/2007 | Chen | 704/246 |
| 2009/0018824 | A1 * | 1/2009 | Teo | 704/203 |
| 2010/0017198 | A1 * | 1/2010 | Yamanashi et al. | 704/205 |
| 2010/0223061 | A1 * | 9/2010 | Ojanpera | 704/500 |
| 2010/0286981 | A1 * | 11/2010 | Krini et al. | 704/206 |

OTHER PUBLICATIONS

Zhao et al, "A Processing Method for Pitch Smoothing Based on Autocorrelation and Cepstral F0 Detection Approaches", IEEE, 2007, p. 59-62.

Taori et al, "Harmony-1: A Versatile Low Bit Rate Speech Coding System", Nat. Lab Technical Note 157, 1997, pp. 1-92.

Hermes, "Measurement of Pitch by Subharmonic Summation", Journal of the Acoustic Society of America, 83(1), Jan. 1988, pp. 257-264.

Zhao et al, "A Processing Method for Pitch Smoothing Based on Autocorrelation and Cepstral F0 Detection Approaches", IEEE, 2007, pp. 59-62.

Chen, "Signal Processing Handbook", Marcel Dekker, Inc., 1988, p. 531.

* cited by examiner

METHOD AND DEVICE FOR ESTIMATING A PATTERN IN A SIGNAL

FIELD OF THE INVENTION

The present invention relates to a method, a corresponding device and a corresponding computer program for estimating a pattern, in particular a pitch and/or a fundamental frequency, in a signal having a periodic, a quasiperiodic or virtually periodic component.

BACKGROUND OF THE INVENTION

Pitch detection can be used for different applications like voice modification, text-to-speech transformation, speech coding, music information retrieval, musical performance systems, biometric measurements, astrophysical measurements etc. For a pitch detection time domain and frequency domain approaches are well known. The time domain approaches can be implemented cheap and easily e.g. by measuring the zero-crossing rate as described by C. H. Chen, Signal Processing Handbook, New York: Dekker, p. 531, 1988 or by a variation of autocorrelation by exploiting the similarity of successive pitch periods as described by R. Bracewell, The Autocorrelation Function, in The Fourier Transform and Its Applications, New York: MacGraw-Hill, pp. 40-45, 1965. The frequency-domain approaches are usually more complex and include the steps of a Fast Fourier Transformation (FFT) to transform the time-domain signal to a frequency-domain signal, removing of the influence of the phase by only considering the power of the frequency components, compressing the values to reduce the influence of spectral envelope, producing pitch candidates by correlation of the underlying harmonics like subharmonic summation and finding the candidate by selecting the highest peak. Such methods are known e.g. from D. J. Hermes, Measurement of pitch by subharmonic summation, in Journal of the Acoustic Society of America, 83, pp. 257-264, 1988. Another possibility to get the pitch candidates is the transformation of the frequency-domain signal back to the time-domain by Inverse Fourier Transformation (IFFT). E.g. the pitch detection algorithm as known from B. E. Bongart et al., The Frequency Analysis of Time Series for Echos: Cepstrum, Pseudoautocovariants, Cross-Cepstrum and Saphe Cracking, in Proceedings of the Symposium on Time Series Analysis, Chapter 15 pp. 209-243, New York: Wiley, 1963 is based upon spectral analysis and uses a log function for compression. If the magnitude is used as a compression operation, the resulting backward transformation is a zero-phase signal. Autocorrelation can be used in this respect, if no compression to the power spectrum is applied.

A strong compression like a log function amplifies the influence of noise and forms wrong pitch candidates. A small compression like the magnitude operation is too low to suppress the influence of spectral envelopes and, therefore, producing wrong candidates from higher harmonics. A compromise is applying a square-root operation on magnitude values as used in a harmony speech coder which is known from R. Taori et al., Harmony-1: A Versatile Low Bit Rate Speech Coding System, Nat. Lab. Technical Note 157/97. The pitch detection methods are provided to determine the right candidate out of multiple candidates, however, if the candidates are close to each other, a wrong candidate may be chosen. Further, if higher and/or lower octaves of a pitch are strongly represented, false candidates may be selected by the pitch detection methods known from the prior art.

SUMMARY OF THE INVENTION

It is an object of the present invention to provide an improved method, device and computer program for estimating a pattern, in particular a pitch and/or a fundamental frequency, in a signal more reliably.

In a first aspect of the present invention a method for estimating a pattern, in particular a pitch and/or a fundamental frequency, in a signal having a periodic, quasiperiodic or virtually periodic component, comprising:

transforming the signal from a time-domain to a frequency-domain to obtain a spectrum of the signal, processing the spectrum to obtain a zero-phase spectrum of the signal, transforming the zero-phase spectrum of the signal to the time-domain to obtain a correlation signal, combining the spectrum and the correlation signal to a combined spectrum, and estimating the pattern on the basis of the combined spectrum.

In a further aspect of the present invention a corresponding device is presented, e.g. comprising a processing unit to perform the steps of the above-mentioned method.

In a further aspect of the present invention a corresponding computer program is presented comprising program code means for causing a computer to carry out the steps of the proposed method when said computer program is carried out on the computer.

Preferred embodiments of the invention are defined in the dependent claims. It shall be understood that the claimed device and the claimed computer program have similar and/or identical preferred embodiments as the claimed method and as defined in the dependent claims.

The present invention is based upon the idea that in an additional step the frequency domain spectrum is combined with its time-domain transformation such that the resulting spectrum has a distinct peak at the pitch location and strong attenuation at higher and lower octaves. This method can be used to estimate the pitch and/or the fundamental frequency of a signal. Since the resulting spectrum has just a distinct peak at the pitch location and/or the fundamental frequency, the pitch and/or the fundamental frequency can be detected easily with a high reliability.

According to a preferred embodiment the step of transforming the signal from a time-domain to a frequency-domain comprises a Fourier Transformation, in particular a Fast Fourier Transformation. This provides a possibility to implement a transformation from the time-domain to the frequency-domain with low effort.

According to a further embodiment, the signal is processed by means of a DC-notch filter. The DC-notch filter removes low frequency signals to prevent false detection.

The DC filtered signal is preferably multiplied by a window function. This window operation limits the spectrum to a region that contains at least two pitch periods.

According to a further embodiment, the spectrum of the signal is processed to obtain a magnitude spectrum of the signal. The magnitude calculation of the signal provides a compression operation, which is easily implementable and results in a zero-phase signal after backward transformation.

According to a further embodiment, the spectrum of the signal is compressed to a compressed spectrum, in particular by means of a square-root operation. Alternatively, the compression function may be a root—function in general using e.g. 0.6 as exponent. This operation emphasizes the harmonics of the pitch and attenuates the influence of the spectral envelopes.

According to a further embodiment the spectrum of the signal is windowed by means of a window function, in particular by using the right half of a Hanning window or other window functions, which have a similar effect. This window operation attenuates noisy high frequency components.

According to a further embodiment the transformation of the zero-phase spectrum, in particular of a compressed magnitude spectrum of the signal, to the time-domain comprises an Inverse Fourier Transformation. Since the phase of the spectrum, in particular of a compressed spectrum is zero, just the positive axis of the real part of the spectrum need to be computed. This provides a possibility to obtain a correlation signal having peaks at multiples of the pitch period.

According to a further preferred embodiment, the correlation signals is attenuated by means of a window function. This window operation attenuates the effect of the spectral envelope on the correlation signal.

According to a preferred embodiment the combination of the spectrum and the correlation signal comprises resampling of at least one of the spectrum or the correlation signal. The resampling provides a possibility to combine the spectrum and the correlation signal having inversely proportional axes. In particular, it is preferred to use a logarithmic scale. This provides a possibility to combine spectrum and signal having a large difference in resolution for high and low frequencies of the different domains.

According to a preferred embodiment the estimating of the pattern comprises searching for an absolute maximum of the combined signal. This provides a reliable and simple possibility to find the pitch and/or the fundamental frequency of the signal.

According to a preferred embodiment the signal is rectified, in particular by means of a full-wave rectification function. This provides a possibility to determine the pitch and/or the fundamental frequency of a signal when the fundamental frequency is missing without degrading the performance for non-filtered signals.

According to a preferred embodiment the zero-phase spectrum of the rectified signal is compared with the zero-phase spectrum of the non-rectified signal and wherein the maximum of these signals is selected and combined with the correlation signal to form the combined signal. The reason for taking the maximum of the spectra is that in case of pure sinusoidal signals, the rectification removes the fundamental frequency and produces only higher harmonics. To reduce the distortion, the spectra of the rectified and the non-rectified signal are combined by selecting the maximum of these spectra.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
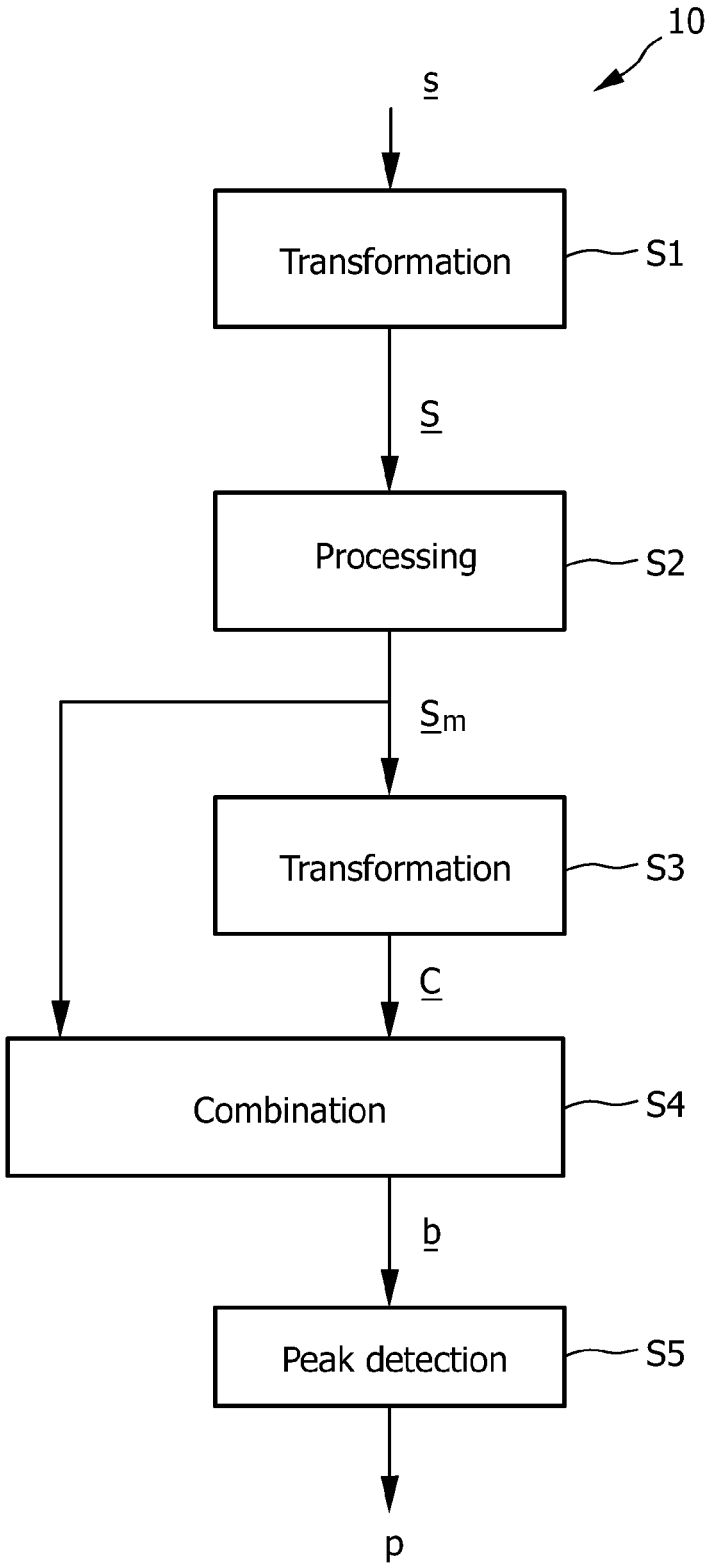
FIG. 1 shows a schematic flow diagram of a pitch detection method according to the present invention.

FIG. 1 shows a flow diagram of a method to detect a pitch and/or a fundamental frequency of a signal having a periodic, a quasiperiodic or a virtual periodic component generally denoted by 10. Examples for those signals are recordings of voiced speech, musical tone of an instrument, body signals like heart beat, radio signals from stars, activity monitoring signals. An input signal $\underline{s}$, which is a quasiperiodic or virtually periodic signal like a voice signal, is transformed in step S1 from a time-domain signal to a frequency-domain spectrum. The transformation preferably comprises a Fast Fourier Transformation (FFT). Step S1 provides a spectrum $\underline{S}$ of the signal $\underline{s}$. The spectrum $\underline{S}$ is processed in step S2 to remove the phase information of the spectrum and to obtain a zero-phase spectrum ($S_m$). The processing comprises computing the magnitude of the spectrum $\underline{S}$ and optionally a spectral compression of the spectrum $\underline{S}$, e.g. by means of a square-root operation. The processing and/or compression step S2 emphasizes the harmonics of the pitch and attenuates the influence of the spectral envelope. Step S2 provides a zero-phase spectrum $\underline{S}_m$.

The zero-phase spectrum $\underline{S}_m$ is transformed in step S3 from the frequency-domain to the time-domain preferably using an Inverse Fourier Transformation. The Transformation step S3 provides a correlation signal $\underline{c}$, which comprises peaks at multiples of the pitch period.

The zero-phase spectrum $\underline{S}_m$ and the correlation signal $\underline{c}$ are combined in step S4 to a combined spectrum $\underline{b}$. The combined spectrum $\underline{b}$ comprises a distinct peak at the pitch, wherein the higher harmonics in the frequency spectrum and the multiples of the pitch period are attenuated leaving the pitch and/or the fundamental frequency as a predominant peak. The combination S4 is performed by multiplying the zero-phase spectrum $\underline{S}_m$ with the correlation signal $\underline{c}$.

On the basis of the combined spectrum $\underline{b}$, a peak detection S5 is performed to estimate the pitch and/or the fundamental frequency of the signal. The peak detection S5 comprises searching for the maximum in the combined spectrum $\underline{b}$ and provides the output signal p, which corresponds to the pitch and/or the fundamental frequency of the source signal $\underline{s}$.

The step S4 of combining the zero-phase spectrum $\underline{S}_m$ with its time-domain transformation $\underline{c}$ results in the combined spectrum $\underline{b}$, which has a distinct peak at the pitch location and/or the fundamental frequency and strong attenuation and higher and lower octaves. Hence, the peak detection is reliable, since the pitch location and/or the fundamental frequency correspond to highest peak in the combined spectrum $\underline{b}$.

Figure 2:
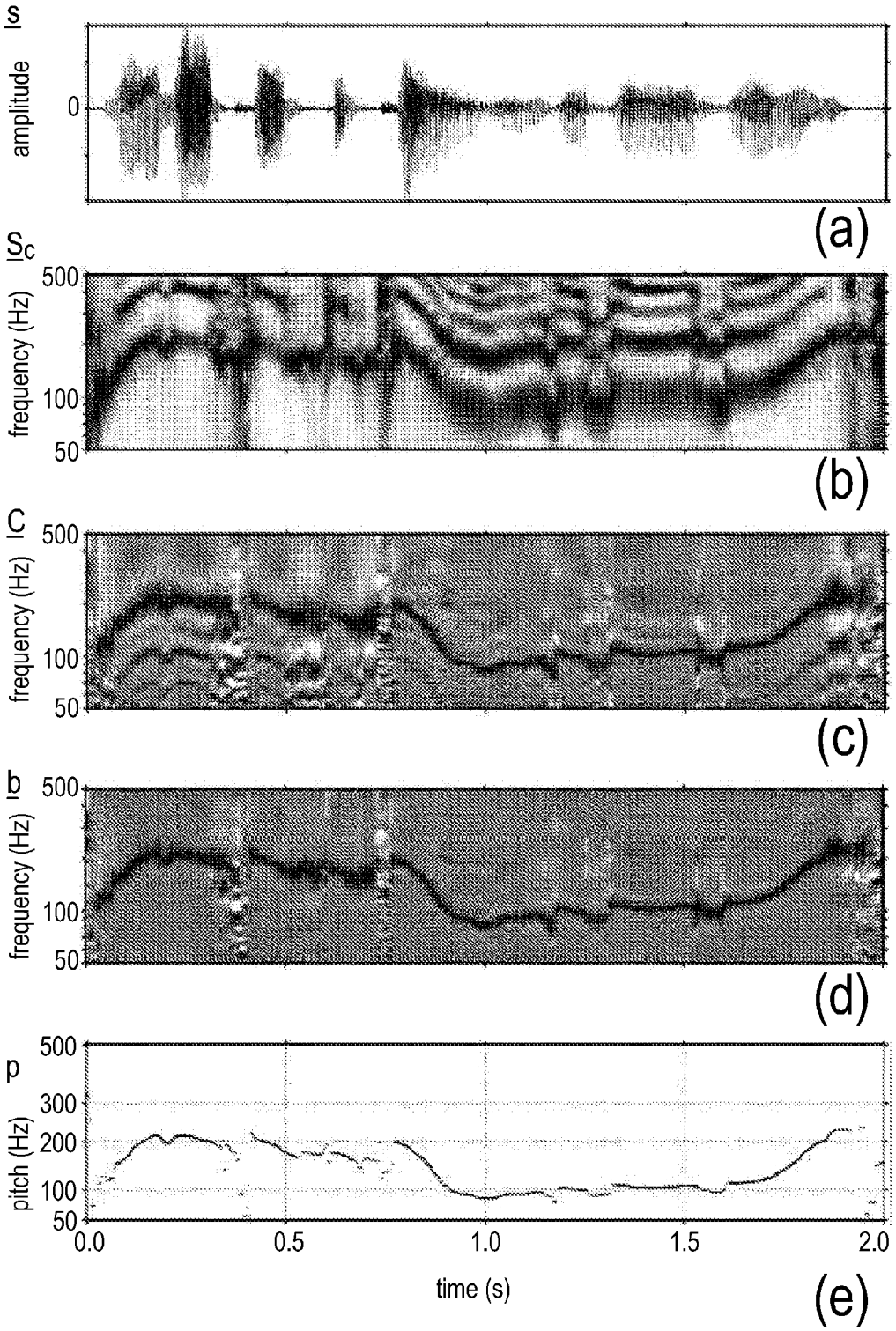
FIG. 2 shows a diagram of the source signal to be processed and the compressed spectrum, the correlation signal, the combined spectrum and the measured pitch derived from the source signal by the pitch detection method.

FIG. 2 shows five diagrams FIG. 2A-E showing the amplitude of the source signal $\underline{s}$, the frequency of a compressed spectrum $\underline{S}_c$, the frequency of the correlation signal $\underline{c}$, the frequency of the combined spectrum $\underline{b}$, and the output signal, the pitch p of the source signal $\underline{s}$ versus time.

The source signal $\underline{s}$ shown in FIG. 2A is the time-domain of the English sentence "do they take the car when they go aboard". The compressed signal $\underline{S}_c$ derived from the source signal $\underline{s}$ by means of the transformation step S1 and the processing and compression step S2 is shown in FIG. 2B.

The frequency of the correlation signal $\underline{c}$ derived from the compressed spectrum $\underline{S}_c$ by means of the transformation step S3 is shown in FIG. 2C.

The frequency of the combined spectrum $\underline{b}$ derived from the combination of the compressed spectrum $\underline{S}_c$ and the correlation signal $\underline{c}$ by means of step S4 is shown in FIG. 2D.

The pitch p versus time derived from the combined spectrum $\underline{b}$ by means of the peak detection of step S5 is shown in FIG. 2E.

Hence, FIG. 2 shows the signals or spectra provided by the certain method steps S1 to S5 versus time.

Figure 3:
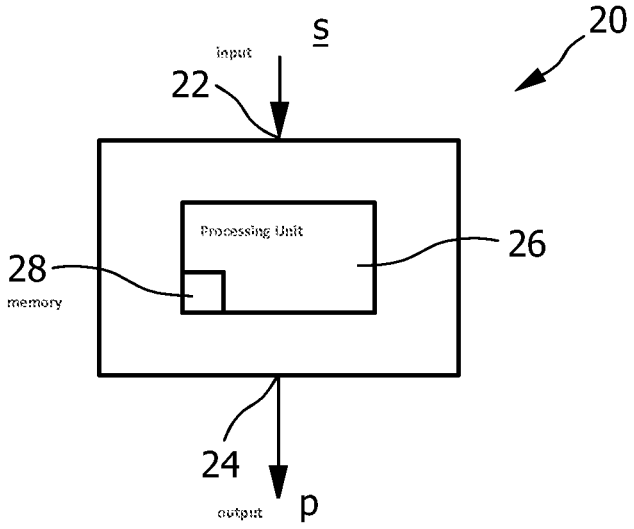
FIG. 3 shows a schematic drawing of a device for performing the pitch detection according to the present invention.

FIG. 3 shows a schematic block diagram of an apparatus to perform the pitch detection, which is generally denoted by 20.

The apparatus 20 comprises a signal input 22 and a signal output 24 to receive the source signal $\underline{s}$ and to provide the output signal p, respectively. The apparatus 20 comprises a processing unit 26 for processing the input signal $\underline{s}$ and to estimate the pitch and/or the fundamental frequency of the input signal $\underline{s}$. The processing unit 26 provides the output signal p to the output 24 of the apparatus 20. The processing unit 26 comprises a memory 28 to store program codes for causing the processing unit 26 to carry out method steps to process the input signal $\underline{s}$.

The processing unit 26 can be implemented by an integrated circuit or a computer or may be implemented by means of discrete elements and/or devices which perform the necessary processing steps.

Figure 4:
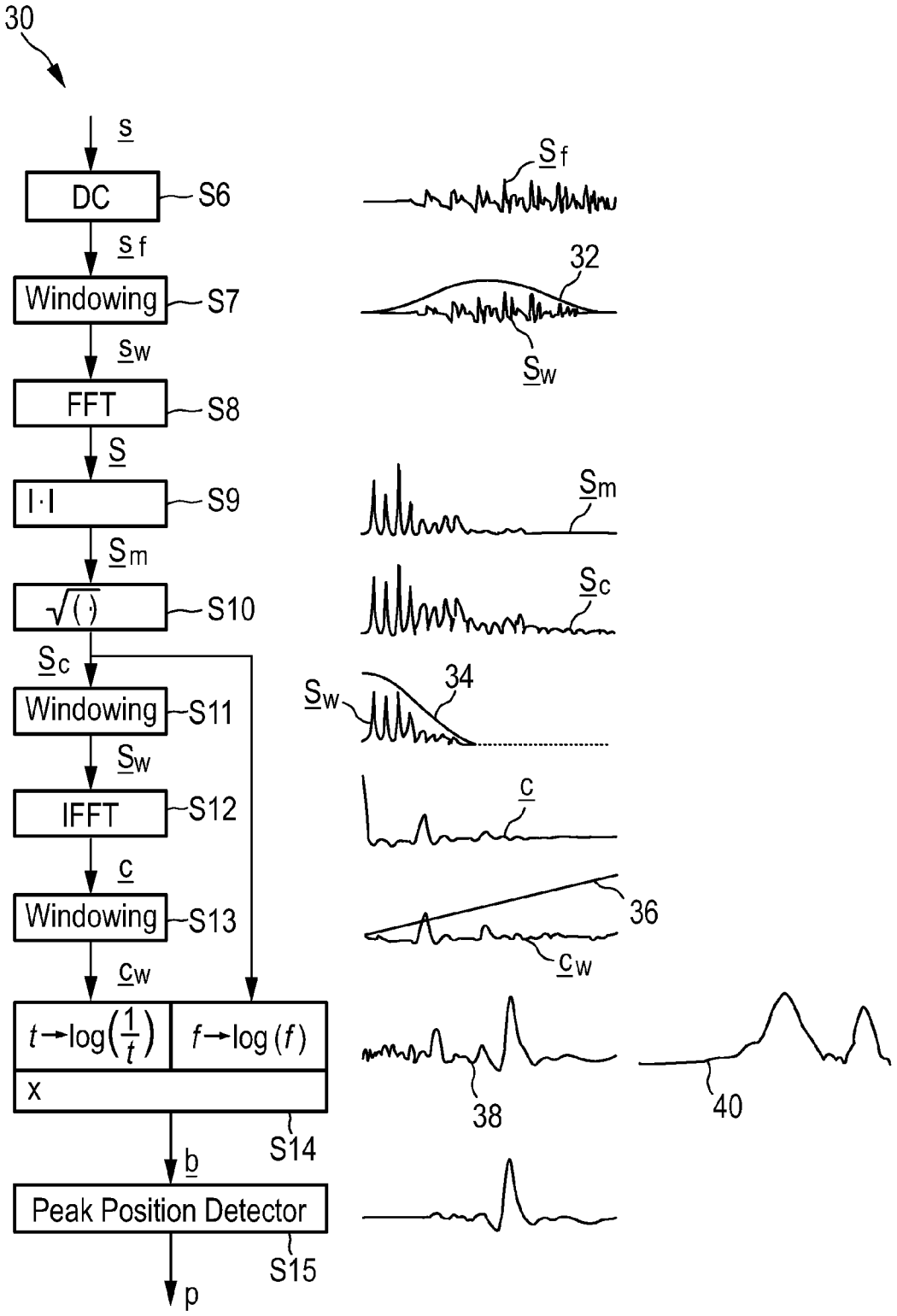
FIG. 4 shows a flow diagram of an embodiment of the method for pitch detection.

FIG. 4 shows a flow diagram of a pitch detection method generally denoted by 30 and the corresponding signals or spectra provided by the certain method steps.

The source signal $\underline{s}$ is preferably filtered by means of a DC-notch filter in a first step S6. Low frequencies of the input signal $\underline{s}$ can distort the pitch detection process due to the windowing step before the Fourier Transformation from the time-domain to the frequency-domain. The windowing step smears the energy of a dominant DC signal to higher frequencies, and can emphasize weak low frequencies of the source signal $\underline{s}$. To prevent false detection, the low frequencies of the source signal $\underline{s}$ need to be removed before the following windowing process. The DC-notch filter of step S6 is used to remove the low-frequencies of the source signal $\underline{s}$. The DC-notch filter according to S6 comprises the transfer function:

$$H_{dc}(z) = \frac{1 - z^{-1}}{1 - \alpha \cdot z^{-1}}$$

wherein $$\alpha = \frac{f_s}{f_s + f_c}$$

and $f_s$ is the sampling frequency and $f_c$ the cut-off frequency in Hz, at which an output power of the DC-notch filter is reduced to 50% of the input power (−3 dB).

The filter implementation in time-domain is:

$$s_f[n]=s[n]-s[n-1]+\alpha \cdot s_f[n-1]$$

including the source signal $\underline{s}$, the DC-filtered signal $\underline{s}_f$ as an output signal of step S6 and n as the $n^{th}$ input sample. For a speech signal, a sampling frequency of 8 kHz and a cut-off frequency of 500 Hz cc is approximately 0.94. The output signal of the DC-notch filter $\underline{s}_f$ does not comprise low frequency components as shown in FIG. 4.

The following step S7 is a window function. The DC filtered signal $\underline{s}_f$ is multiplied by a window function 32. The window function 32 attenuates possible discontinuities at the edges and limits the signal to a region that contains at least two pitch periods. For example, if the lowest pitch is expected to be 40 Hz, the window duration needs to be at least 50 msec. Preferably, a Hanning window function is used:

$$w[n] = 0,5 - 0,5 \cdot \cos\left(\frac{2\pi(n + 0,5)}{L}\right),$$

$$0 \le n < L$$

Alternatively a Hamming window function or any other window function with similar characteristics can be used. L depends on the sampling frequency, wherein L is 400 for a sampling frequency of 8 kHz and 50 msec duration.

The windowing operation is defined by:

$$s_w[n]=s_f[n] \cdot w[n],\ 0 \le n < L$$

wherein $s_w$ is the output signal of the windowing function of step S7.

The signal $\underline{s}_w$ is transformed from the time-domain to the frequency-domain in step S8. This transformation comprises a Discrete Fourier Transformation (DFT) to provide a spectrum $\underline{S}$ of the signal $\underline{s}_w$. The transformation function of the Discrete Fourier Transformation is given by:

$$S[k] = \sum_{n=D}^{L-1} s_w[n] \cdot e^{-j\frac{2\pi kn}{M}},$$

$$0 \le k < M$$

For efficiency reasons preferably a radix-2 FFT is used. In that case the size M of the DFT has the power of 2 and is closest to, but not smaller than L. E.g. for L of 400, M is set to 512.

In step S9 the magnitude spectrum of the frequency spectrum $\underline{S}$ is calculated. Since $\underline{s}_w$ is a real value signal and $\underline{S}$ is symmetric around zero, only the positive axis is used for the calculation of the magnitude. Thus, the formula of the Fourier Transformation mentioned above can be rewritten as:

$$S_R[k] = \sum_{n=0}^{L-1} s_w[n] \cdot \cos\left(\frac{2\pi kn}{M}\right),$$

$$0 \le k < \frac{M}{2}$$

$$S_I[k] = \sum_{n=0}^{L-1} s_w[n] \cdot \sin\left(-\frac{2\pi kn}{M}\right),$$

wherein $\underline{S}_R$ is the real part and $\underline{S}_I$ is the imaginary part of the spectrum. The magnitude is calculated in step S9 by the formula:

$$S_m[k] = |S[k]| = \sqrt{(S_R[k])^2 + (S_I[k])^2},$$

$$0 \le k \le \frac{M}{2}$$

wherein $\underline{S}_m$ is the output frequency spectrum of Step S9. In the following step S10, the magnitude spectrum $\underline{S}_m$ is compressed by a square-root operation:

$$S_C[k] = \sqrt{S_m[k]},$$

$$0 \le k \le \frac{M}{2}$$

The square-root operation emphasizes the harmonics of the pitch and attenuates the influence of the spectral envelope, e.g. like the formants in a speech signal. The output signal of the compression of S10 is a compressed magnitude spectrum $\underline{S}_c$.

In step S11, the compressed magnitude spectrum $\underline{S}_c$ is windowed in the frequency-domain to attenuate noisy high frequency components preferably by using the right half of a Hanning window:

$$S_w[k] = S_c[k] \cdot W[k],$$

$$0 \le k \le \frac{M}{2}$$

wherein $$W[k] = \begin{cases} 0,5 + 0,5 \cdot \cos\left(\frac{\pi(k+0,5)}{N}\right), & 0 \le k < N \\ 0, & \text{otherwise} \end{cases}$$

N determines the size of the pass-band. For a speech signal having a sampling frequency of 8 kHz and a pass band of 2 kHz N=M/4. The window function of S10 is shown at 34. The output signal of step S11 is the windowed compressed magnitude spectrum $\underline{S}_w$ as shown in FIG. 4.

The windowed compressed magnitude spectrum $\underline{S}_w$ is transformed in step S12 to the time-domain using an Inverse Fourier Transformation (IFT). The FFT size remains as shown above:

$$c[n] = \sum_{k=0}^{N-1} S_w[k] \cdot e^{j\frac{2\pi nk}{M}},$$

$$0 \le n < M$$

Since the phase of the windowed compressed magnitude spectrum $\underline{S}_w$ is zero, only the positive axis of the real-part of the spectrum is needed for the inverse transformation:

$$c[n] = \sum_{k=0}^{N-1} S_w[k] \cdot \cos\frac{2\pi nk}{M},$$

$$0 \le n \le \frac{M}{2}$$

This transformation to the time-domain is used to obtain the correlation signal $\underline{c}$, that comprises peaks at multiples of the pitch period as shown in FIG. 4.

In step S13 the correlation signal $\underline{c}$ is windowed to further attenuate the effect of spectral envelope. Preferably a simple window function 36 is used for this attenuation step:

$$c_w[n] = c[n] \cdot n,$$

$$0 \le n \le \frac{M}{2}.$$

The output signal of step S13 is a windowed correlation signal $\underline{c}_w$.

In step 14 a combined spectrum $\underline{b}$ is formed by multiplying the compressed magnitude spectrum $\underline{S}_c$ and the attenuated correlation signal $\underline{c}_w$. This combined spectrum $\underline{b}$ has a distinct peak at the fundamental frequency. By multiplying these spectra, the higher harmonics in the frequency spectra and the multiples of the pitch periods are attenuated, wherein the fundamental frequency and/or the pitch remains as a predominant peak. Prior to the combination of the spectra, resampling of at least one of the spectra may be used, since the axes are inversely proportional, wherein:

$$n = \frac{M}{k}.$$

Because of the difference of the resolution for low and high frequencies between the different domains, the combination is preferably performed by using a logarithmic scale:

$$b[i] = c_w[n_i] \cdot S_c[k_i],$$

$$0 \le i \le R$$

$$i = R\frac{\log k - \log k_{min}}{\log k_{max} - \log k_{min}},$$

$$k_{min} \le k \le k_{max}$$

$$k_i = \frac{\exp\left(\frac{i}{R}(\log k_{max} - \log k_{min}) + \log k_{min}\right)}{M}$$

$$n_i = \frac{M}{k_i},$$

wherein $k_{min}$ and $k_{max}$ correspond to the valid pitch range. E.g. for speech, a pitch range between 40 and 600 Hz is usual. R determines the output array size. It is sufficient to use the input window length for R with L=R.

The resampling operation is preferably performed by using spline-interpolation:

$$c_w[n_i] = c_w[n_i' - 1]\left(\left(\left(\frac{4}{5} - \frac{1}{3}n_i''\right)n_i'' - \frac{7}{15}\right)n_i''\right) + c_w[n_i']\left(\left(\left(n_i'' - \frac{9}{5}\right)n_i'' - \frac{1}{5}\right)n_i'' + 1\right) + c_w[n_i' + 1]\left(\left(\left(\frac{6}{5} - n_i''\right)n_i'' + \frac{4}{5}\right)n_i''\right) + c_w[n_i' + 2]\left(\left(\left(\frac{1}{3}n_i'' - \frac{1}{5}\right)n_i'' + \frac{2}{15}\right)n_i''\right)$$

wherein $n_i'=[n_i]$, $n_i''=n_i-n_i'$ and $[n_i]$ denotes the quantization operation that removes the fractional part. The same interpolation is also applied to $\underline{S}_w$, wherein $k_i'$ is the quantized index of $k_i$.

The quantized indices as well as the spline coefficients can be pre-calculated and stored in an array to avoid lengthy calculations for the complex log- and exp-operations. The resampled spectra, which are combined in S14 are shown in FIG. 4 and denoted by 38, 40.

The peak position detection as the final step S15 comprises searching for the maximum of the combined spectrum $\underline{b}$:

$$m_i = \max_i \{b[i]\},$$

$$0 \le i \le R$$

$$p_l = i|_{b[i]=m_l}$$

wherein $m_l$ is the maximum and $p_l$ the location of the maximum in the scaled logarithmic domain. The pitch in the linear domain in Hz is determined by:

$$p = f_s \frac{\exp\left(\frac{p_l}{R}(\log k_{max} - \log k_{min}) + \log k_{min}\right)}{M}$$

Figure 5:
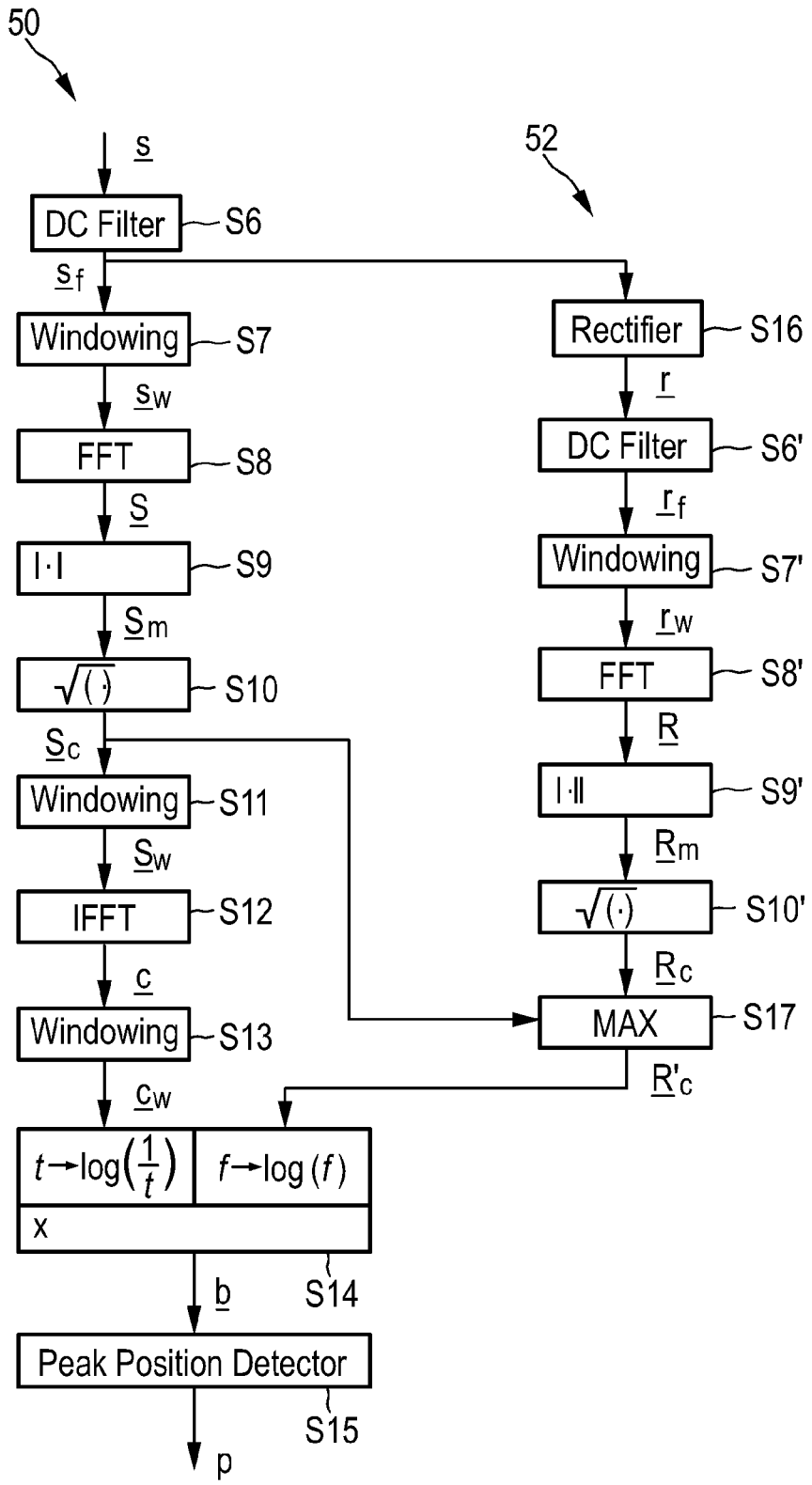
FIG. 5 shows a flow diagram of a further embodiment of the method for pitch detection.

In FIG. 5 a further embodiment of the method for pitch detection is generally denoted by 50. The method 50 is similar to the method 30 shown in FIG. 4. Identical steps and signals are denoted by identical reference signs, wherein just the differences are explained in detail.

The method 50 is preferably used to find the pitch of the source signal $\underline{s}$ when the fundamental frequency is missing. In cases when high-pass filters are applied to the signal prior to the pitch detection, e.g. like telephone speech, the fundamental frequency is lost. The method 50 is provided to bring back the fundamental frequency without degrading the performance for non-filtered signals.

The method 50 comprises a separate path 52 to provide a rectified spectrum of the DC-filtered signal $\underline{s}_f$.

The DC-filter signal $\underline{s}_f$ is rectified in step S16 to provide the rectified signal $\underline{r}$. Preferably the DC-filtered signal $\underline{s}_f$ is full-wave rectified by means of a full-wave rectifier. The formula of the full-wave rectifier is given by:

$$r[n] = |s_f[n]|.$$

The rectifying step S16 is followed by the steps S6' to S10' to provide a rectified compressed magnitude spectrum $\underline{R}_c$ of the rectified signal. The steps S6' to S10' are identical with steps S6 to S10 as described above. In step S17 the compressed magnitude spectrum $\underline{S}_c$ of the non-rectified signal $\underline{s}_f$ and the rectified compressed magnitude spectrum $\underline{R}_c$ are combined. For reducing the distortion and for the case that the rectification removes the fundamental frequency and produces only higher harmonics, the rectified compressed magnitude spectrum $\underline{R}_c$ of the rectified signal $\underline{r}$ and the non-rectified signal $\underline{s}$ are combined, wherein the maximum of these spectra is selected according to the formula:

$$R_c'[k] = \max\{dR_c[k], S_c[k]\},$$

$$0 \le k \le \frac{M}{2}$$

wherein d is a scaling factor and preferably set to 2. The output signal of S17 is $\underline{R}_c'$, the maximum of the compressed magnitude spectrum of the rectified signal and the non-rectified signal.

The output signal of S17 is combined with the attenuated correlation signal $\underline{c}_w$ in step S14 as described above.

Figure 6:
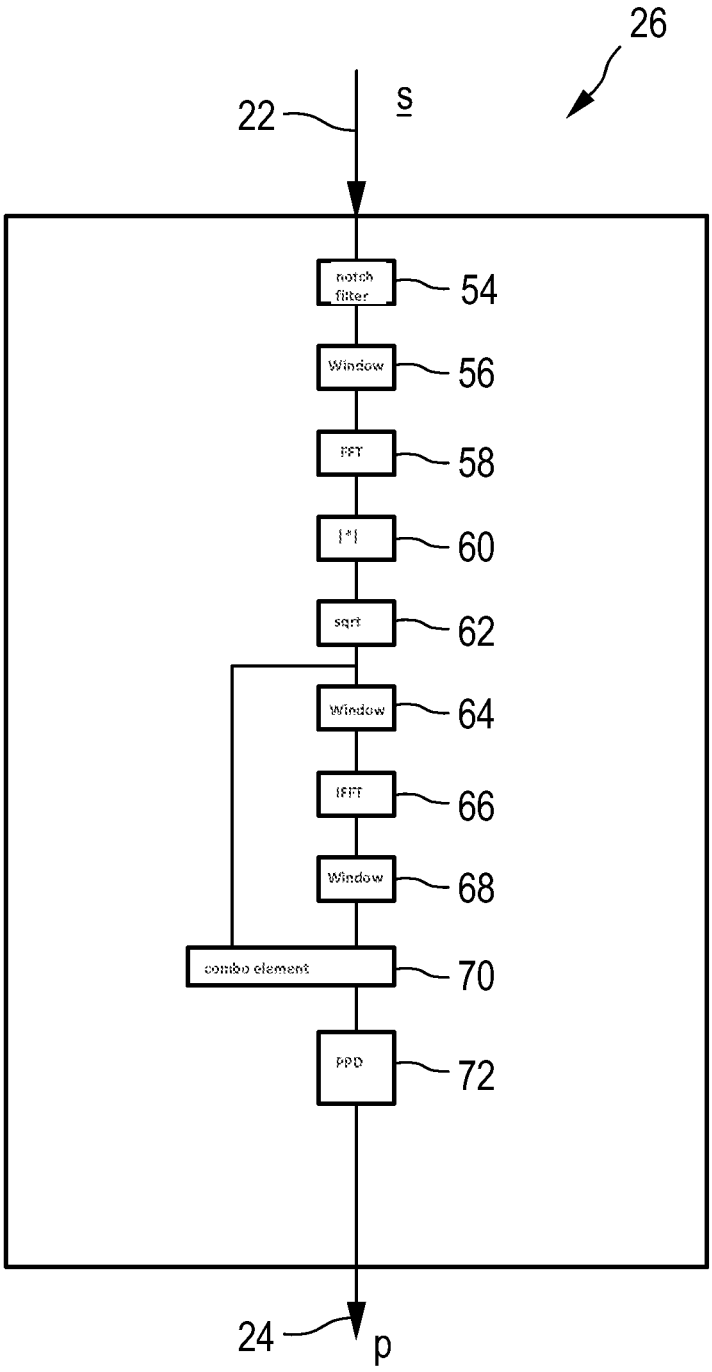
FIG. 6 shows a schematic block diagram of a processing unit performing the method according to FIG. 4.

FIG. 6 shows a schematic block diagram of an embodiment of the processing unit 26 as shown in FIG. 3. The processing unit 26 according to FIG. 6 comprises certain discrete elements or devices, which are provided to perform the steps of the method according to FIG. 4.

The input 22 is connected to a DC-notch filter 54 performing step S6. The DC-notch filter 54 is connected to a windowing element 56 performing step S7. The windowing element 56 is connected to a Fourier Transformation element 58 performing step S8. The Fourier Transformation element 58 is connected to a magnitude element 60 provided to calculate the magnitude according to step S9. The magnitude element 60 is connected to a root operation element 62, which performs step S10. The root operation element 62 is connected to a windowing element 64, which is provided to perform step S11. The windowing element 64 is connected to an Inverse Fourier Transformation element 66, which is provided to perform S12. The Inverse Fourier Transformation element is connected to a windowing element 68, which is provided to perform S13. The windowing element 68 is connected to the combination element 70, which is provided to perform S14. The root operation element 62 is also connected to the combination element 70 to provide the compressed magnitude spectrum $\underline{S}_c$ to the combination element 70. The combination element 70 is connected to a peak position detector element 72, which is provided to perform step S15. The peak position detection element 72 is connected to the output of the processing unit 26 to provide the pitch p to the output 24.

Figure 7:
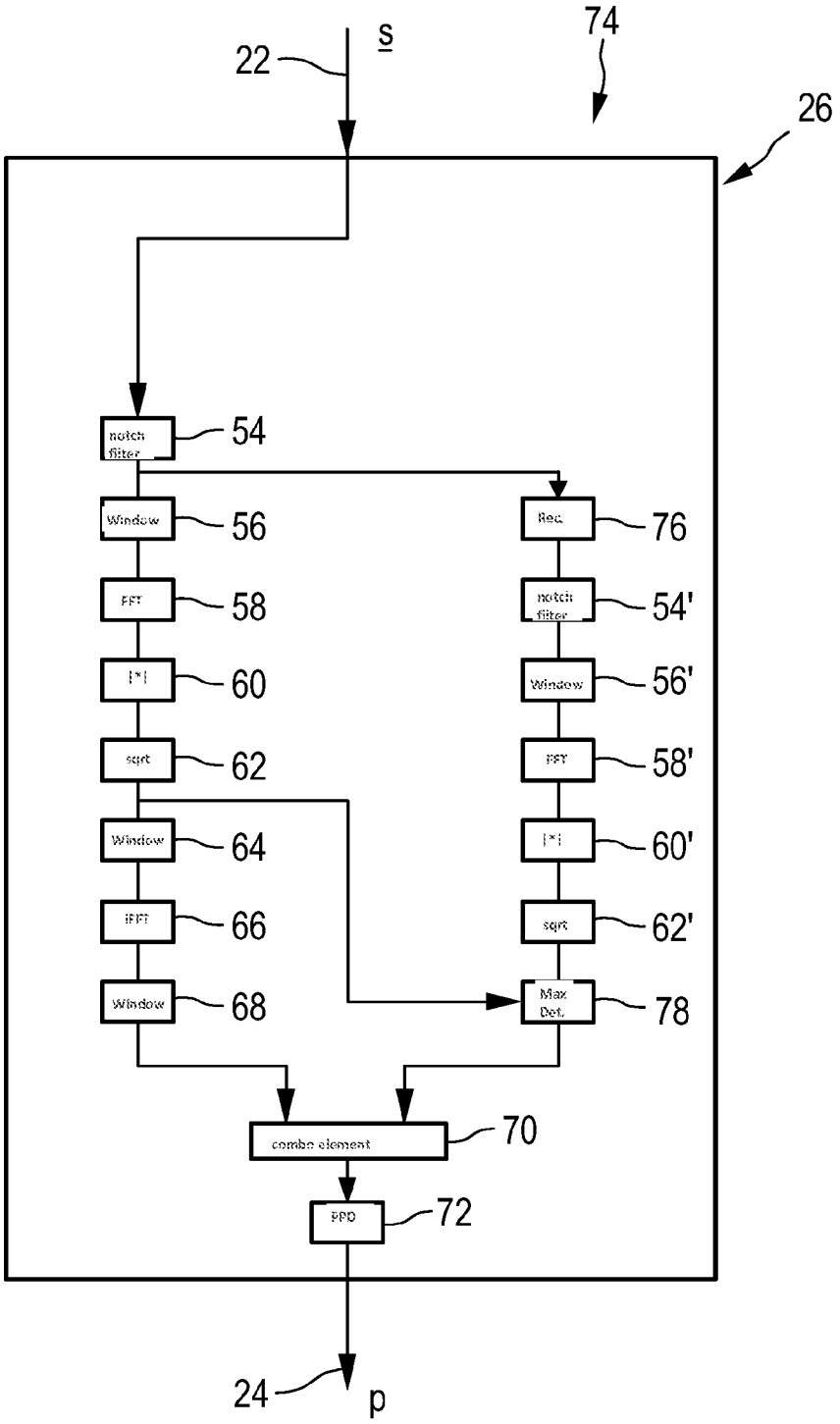
FIG. 7 shows a schematic block diagram of a processing unit performing the method according to FIG. 5.

FIG. 7 shows a schematic block diagram of an embodiment of the processing unit 26 as shown in FIG. 6. Reference is made to FIG. 6, wherein identical steps, elements and signals are denoted by identical reference signs and just the differences are explained in detail. The processing unit 26 according to FIG. 7 comprises certain discrete elements or devices, which are provided to perform the steps of the method according to FIG. 5.

According to this embodiment, the processing unit 26 of FIG. 7 comprises an additional parallel path 74 to provide a rectified compressed magnitude spectrum of the source signal $\underline{s}$. The path 74 performs the steps of path 52 shown in FIG. 5. Path 74 comprises a rectifier 76, which is connected to the DC notch filter 54, to perform step S16. The rectifier 76 is connected to a cascade of the elements 54', 56', 58', 60' and 62' which are identical with elements 54, 56, 58, 60 and 62, respectively, to perform the steps S6', S7', S8', S9' and S10'. The root operation elements 62 and 62' are connected to a maximum determining element 78 performing step S17. The maximum determining element 78 is connected to the combination element 70 performing step S14.

Figure 8:
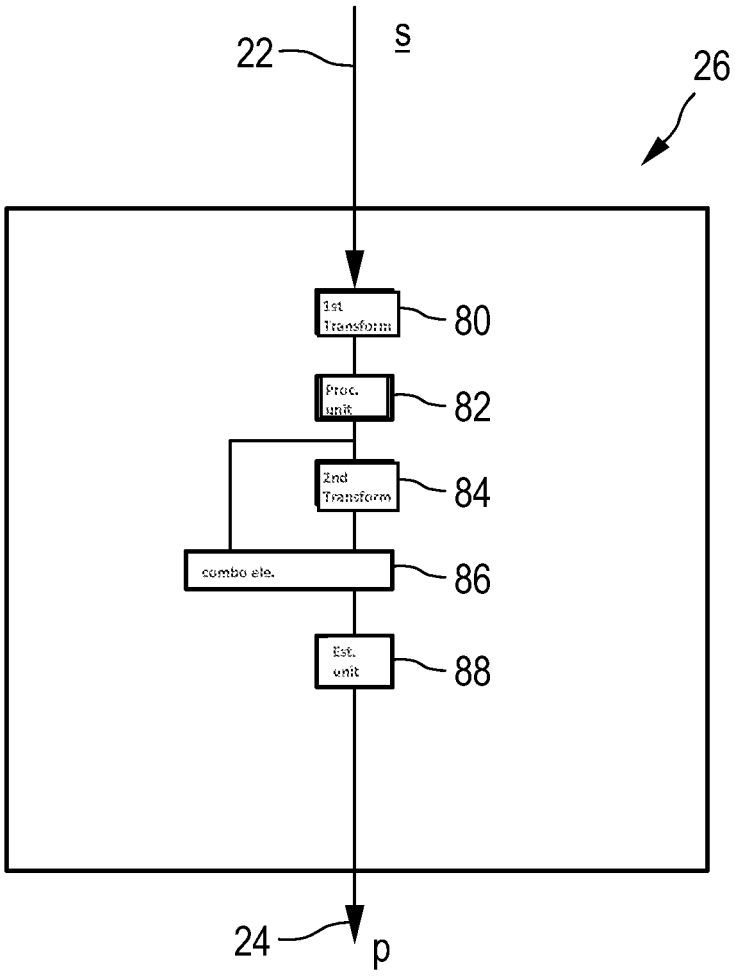
FIG. 8 shows a schematic block diagram of a processing unit performing the method according to FIG. 1.

FIG. 8 shows a schematic block diagram of an embodiment of the processing unit 26 as shown in FIG. 3 to perform the method according to FIG. 1. Generally, the processing unit 26 is also called "device" or "system".

The processing unit 26 comprises a first transformation unit 80 to perform step S1, a processing unit 82 to perform step S2, a second transformation unit 84 to perform step S3, a combination unit 86 to perform step S4 and an estimation unit 88 to perform step S5.

Thus, the steps of the methods 10, 30 and 50 can be carried out by discrete elements in the processing unit 26 as mentioned above. In an alternative embodiment, the steps of the methods 10, 30 and 50 can be carried out by the processing unit 26, which can be implemented by an integrated circuit, like a FPGA or an ASIC or the like or which can be implemented by software running on a computer or control unit.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A method for estimating a fundamental frequency pattern in a signal having a periodic, quasi-periodic or virtually periodic component, operable in a processing system, the method comprising:

transforming, by the processing system, the signal from a time-domain to a frequency-domain to obtain a spectrum of the signal, processing, by the processing system, the spectrum to obtain a zero-phase spectrum of the signal, transforming, by the processing system, a positive portion of the zero-phase spectrum of the signal to the time-domain to obtain a correlation signal, multiplying, by the processing system, the spectrum and the correlation signal to a combined spectrum, and estimating, by the processing system, the fundamental frequency pattern of the signal based on the combined spectrum.

2. A device for estimating a pitch pattern in a signal having a periodic, quasi-periodic or virtually periodic component, the device comprising:

a processing unit in communication with a memory, the memory include code which when assessed by the processing unit causes the processing unit to:

transform the signal from a time-domain to a frequency-domain to obtain a spectrum of the signal by performing a Fourier Transform of the signal, process the spectrum to obtain a zero-phase spectrum of the signal by a DC notch filter transform a positive portion of the spectrum of the signal to the time-domain to obtain a correlation signal by performing an Inverse Fourier Transform, combine the spectrum and the correlation signal to obtain a combined spectrum by multiplying the spectrum and the correlation signal and estimate the pitch pattern of the signal based on the combined spectrum.

3. A non-transitory memory, the memory modified by encoding with a computer code, the computer code causing a computer to carry out the method of:

transforming, by the computer, the signal from a time-domain to a frequency-domain to obtain a spectrum of the signal, processing, by the computer, the spectrum to obtain a zero-phase spectrum of the signal, transforming, by the computer, a positive portion of the zero-phase spectrum of the signal to the time-domain to obtain a correlation signal, multiplying, by the computer, the spectrum and the correlation signal to a combined spectrum, and estimating, by the computer, the pitch pattern of the signal based on the combined spectrum.

4. The device of claim 2, wherein transforming the signal, by the processing system comprises performing a Fourier Transformation on the signal.

5. The device of claim 2, wherein the signal is processed by means of a DC-notch filter.

6. The device of claim 4, wherein the DC-filtered signal is multiplied by a window function.

7. The device of claim 2, wherein the zero-phase spectrum represents a magnitude spectrum of the signal.

8. The device of claim 7, wherein the magnitude spectrum of the signal is compressed to a compressed spectrum.

9. The device of claim 2, wherein the spectrum of the signal is windowed by means of a window function.

10. The device of n claim 2, wherein the transformation of the zero-phase spectrum of the signal comprises an Inverse Fourier Transformation.

11. The device of claim 2, wherein the correlation signal is attenuated by means of a window function.

12. The device of claim 2, wherein the combination of the spectrum and the correlation signal comprises resampling of at least one of the spectrum or the correlation signal.

13. The device of claim 2, wherein the estimating of the pitch pattern, by the processing system, comprises searching for an absolute maximum of the combined signal.

14. The device of claim 2, wherein the signal is rectified by a full-wave rectification function.

15. The device of claim 14, wherein a zero-phase spectrum of the rectified signal is compared with the zero-phase spectrum of the non-rectified signal and wherein the maximum of these signals is combined with the correlation signal to form the combined signal.

* * * * *